United States Patent [19]

Szlaga

[11] Patent Number: 4,543,938

[45] Date of Patent: Oct. 1, 1985

[54] IN-LINE FUEL RESERVOIR

[75] Inventor: Emil Szlaga, Sterling Hts., Mich.

[73] Assignee: Stant Inc., Connersville, Ind.

[21] Appl. No.: 576,316

[22] Filed: Feb. 2, 1984

[51] Int. Cl.[4] ..... F02M 55/00

[52] U.S. Cl. ..... 123/514; 123/516

[58] Field of Search ..... 123/514, 516, 518, 519, 123/520

[56] References Cited

U.S. PATENT DOCUMENTS

| | | | |
|---|---|---|---|
| 1,860,283 | 5/1932 | Gulick | 123/514 |
| 1,952,790 | 3/1934 | Dean | 221/80 |
| 2,297,238 | 9/1942 | Neugebauer et al. | 123/516 |
| 2,414,158 | 1/1947 | Mock | 158/36.4 |
| 2,612,215 | 9/1952 | Edwards | 158/36.3 |
| 2,672,189 | 3/1954 | Welch | 158/46.5 |
| 2,745,357 | 5/1956 | Strayer | 103/233 |
| 2,771,944 | 11/1956 | Thornburg | 158/36.4 |
| 2,878,889 | 3/1959 | Gilbert | 123/516 |
| 3,598,143 | 8/1971 | Mott | 137/389 |
| 3,884,255 | 5/1975 | Merkle | 137/265 |
| 4,129,106 | 12/1978 | Sellman | 123/514 |
| 4,320,734 | 3/1982 | Balachandran | 123/514 |
| 4,385,615 | 5/1983 | Keane | 123/514 |
| 4,452,213 | 6/1984 | Duprey | 123/514 |
| 4,454,848 | 6/1984 | Duprey | 123/514 |

FOREIGN PATENT DOCUMENTS 2651459 5/1977 Fed. Rep. of Germany ..... 123/516

*Primary Examiner*—Magdalen Y. C. Moy

*Attorney, Agent, or Firm*—Barnes & Thornburg

[57] ABSTRACT

An in-line fuel reservoir for a high pressure fuel metering system having a high pressure pump for pumping fuel to an engine and a low pressure pump for pumping fuel from a fuel tank to the high pressure pump. The fuel reservoir has a fuel supply chamber, a fuel supply inlet to the fuel supply chamber which is coupled to the low-pressure pump, a fuel supply outlet from the fuel supply chamber which is coupled to the high pressure pump, a fuel return inlet coupled to the engine, a fuel return outlet coupled to the fuel tank, a first fuel opening between the fuel return inlet and the fuel supply chamber, a second fuel opening between the fuel return inlet and the fuel return outlet and a valve assembly for controlling the flow of fuel through the first and second fuel openings to direct returned fuel to the fuel supply chamber and the fuel tank. The full reservoir may also include a vent opening between the fuel supply chamber and the fuel return outlet to vent vapor and fuel from the fuel supply chamber.

14 Claims, 4 Drawing Figures

IN-LINE FUEL RESERVOIR

This invention relates to fuel reservoirs, and more particularly, to an in-line fuel reservoir between a low-pressure fuel supply pump and a high-pressure pump near the engine, using existing fuel supply and return lines in a high pressure fuel metering system to ensure a constant fuel supply to the high-pressure pump.

In recent years, there has been an increased emphasis on fuel economy for vehicles. Many vehicle manufacturers have turned to fuel injection as opposed to the traditional carburetor as a method for achieving increased fuel economy without sacrificing performance. Many of these fuel injection systems utilize a high-pressure pump for supplying fuel to the fuel injectors. To ensure that the high-pressure pump has an adequate supply of fuel, many systems utilize an auxiliary low-pressure pump to pump fuel from the fuel tank to the inlet of the high-pressure pump.

Although the use of the auxiliary low-pressure pump in conjunction with the high-pressure pump decreases the likelihood of interruptions in the fuel supply to the high-pressure pump, the system still cannot adequately ensure a continuous supply of fuel to the high-pressure pump. A particular problem occurs when the car turns a corner or goes over a bump. In these situations, the fuel in the tank sloshes and often permits the low-pressure pump to suck air into its inlet. This slug of air is then pumped to the high-pressure pump, causing the high-pressure pump to cavitate.

An objective of the present invention is to provide a fuel reservoir in a high pressure fuel metering system between an auxiliary low pressure pump and a high pressure pump to provide a constant fuel supply to the high pressure pump.

It is a further objective of the present invention to utilize existing fuel supply and fuel return lines in a high pressure fuel metering system to route fuel to and from an in-line fuel reservoir for the purpose of supplying a constant fuel supply to a high pressure pump.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures, in which.

An apparatus constructed in accordance with the instant invention is utilized in a high pressure fuel metering system having an auxiliary low-pressure pump for supplying fuel from a fuel tank to a high-pressure pump. The apparatus includes a fuel reservoir connected in the fuel line between the low-pressure pump and the high-pressure pump. The apparatus has a lower portion or a filter cartridge assembly and an upper portion or a valve-body assembly. The valve-body assembly has a fuel inlet which is coupled to the low-pressure pump to introduce fuel into the filter cartridge assembly. The valve-body assembly has a fuel supply outlet which is coupled to the high-pressure pump. The apparatus also includes a valve responsive to the fuel level within the reservoir for selectively coupling a fuel return line from the engine to the reservoir when the fuel level within the reservoir is less than a desired level and to the fuel tank when the fuel level within the reservoir is at least equal to the desired level. An air/vapor vent is provided in the reservoir and is coupled to the fuel tank to exhaust vapor from the reservoir to the fuel tank.

A high pressure fuel metering system is typically used to supply fuel to fuel injectors of an engine. In a conventional high pressure fuel metering system, the low-pressure pump draws fuel from the fuel tank and pumps the fuel to the inlet of the high-pressure pump. The high-pressure pump draws fuel from its inlet and pumps it to the fuel-injectors of the engine. In order to maintain the required operating pressure, the high-pressure pump must pump a much greater volume of fuel than is required by the fuel-injectors. Therefore, the fuel not forced into the fuel-injectors is diverted to a fuel-return line and subsequently back to the fuel tank.

Figure 1:
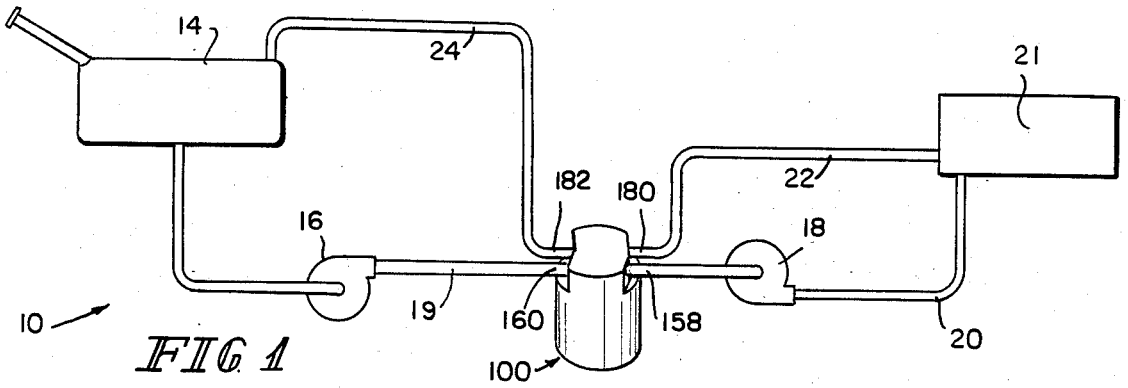
FIG. 1 is schematic view of a high pressure fuel metering system including a fuel reservoir embodying the present invention.

In FIG. 1, a reservoir 100 embodying the present invention is shown connected in a high pressure fuel metering system 10. The fuel system 10 includes a fuel tank 14 coupled to the inlet of a low-pressure pump 16. The outlet of low-pressure pump 16 is coupled to an inlet 160 of fuel reservoir 100. An outlet 158 of fuel reservoir 100 is coupled to high-pressure pump 18. High-pressure pump 18 has a fuel supply outlet line 20 through which fuel is forced into fuel-injectors of an engine 21. Engine 21 may have a fuel regulator (not shown) for regulating fuel supplied to the engine. A fuel-return line 22 couples a fuel return inlet 180 of reservoir 100 to the engine 21. The fuel-return line 22 may be coupled to the regulator associated with the engine 21. A return line 24 is coupled to an outlet 182 of reservoir 100 and couples the reservoir to fuel tank 14. Fuel not forced into the fuel-injectors is diverted through fuel return line 22 to the reservoir 100.

Figure 3:
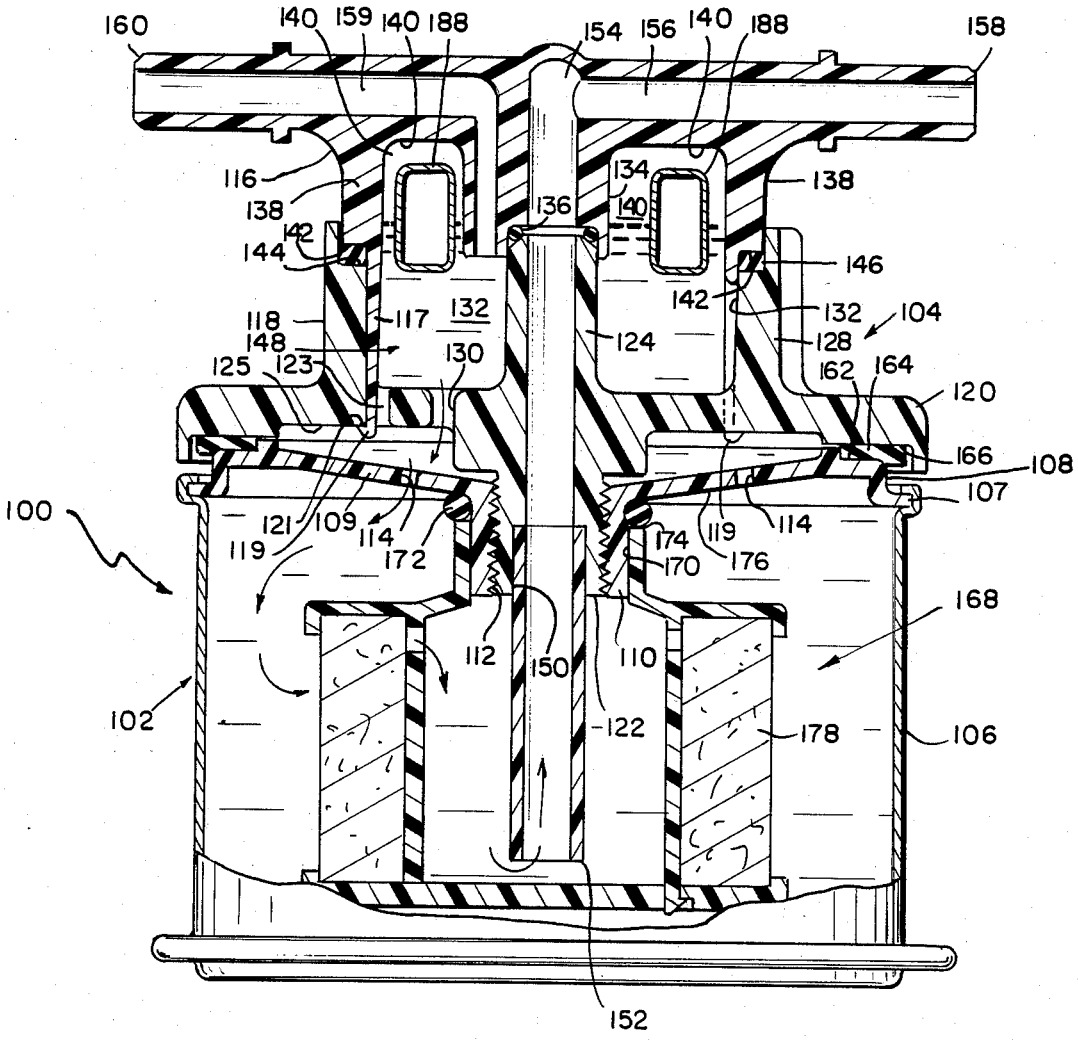
FIG. 3 is a side transverse view of the fuel reservoir shown in FIG. 2 taken along the line 3—3 in FIG. 2.
Figure 2:
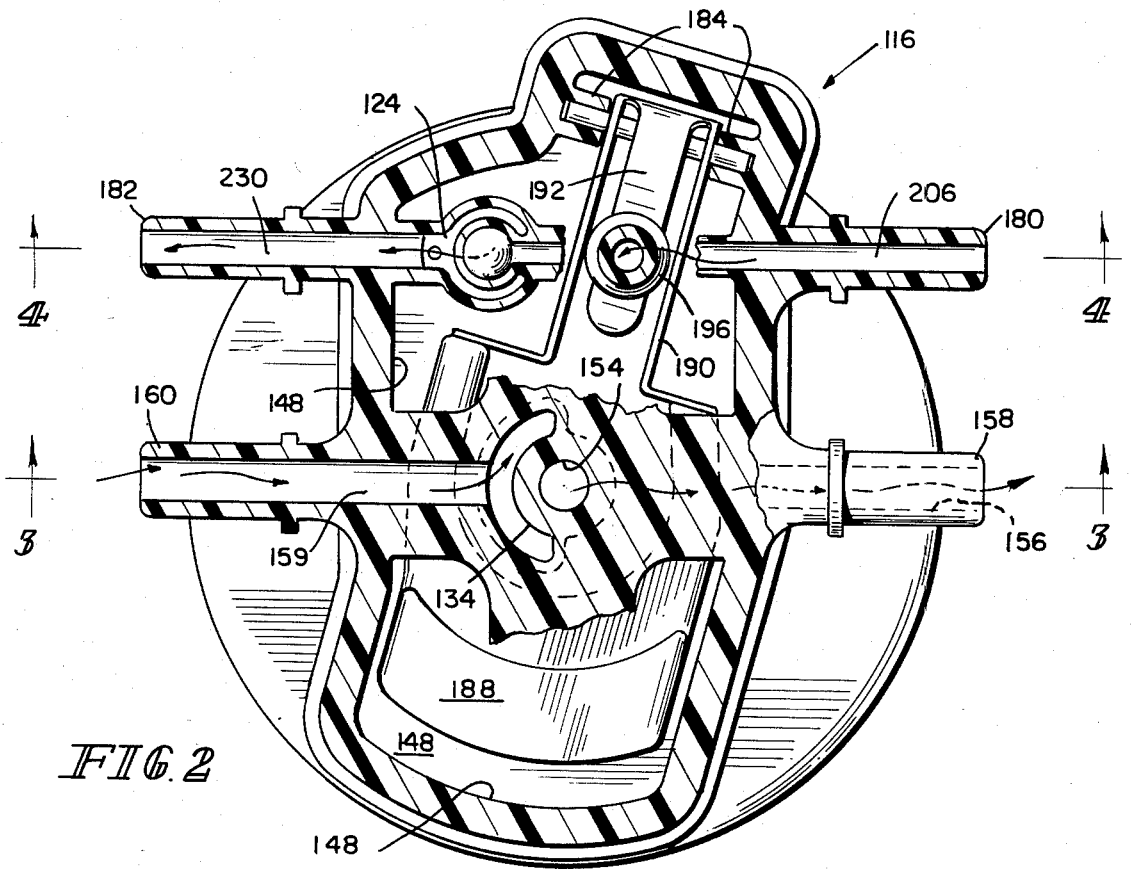
FIG. 2 is a top transverse view, with sections broken away, of a fuel reservoir constructed in accordance with the present invention.
Figure 4:
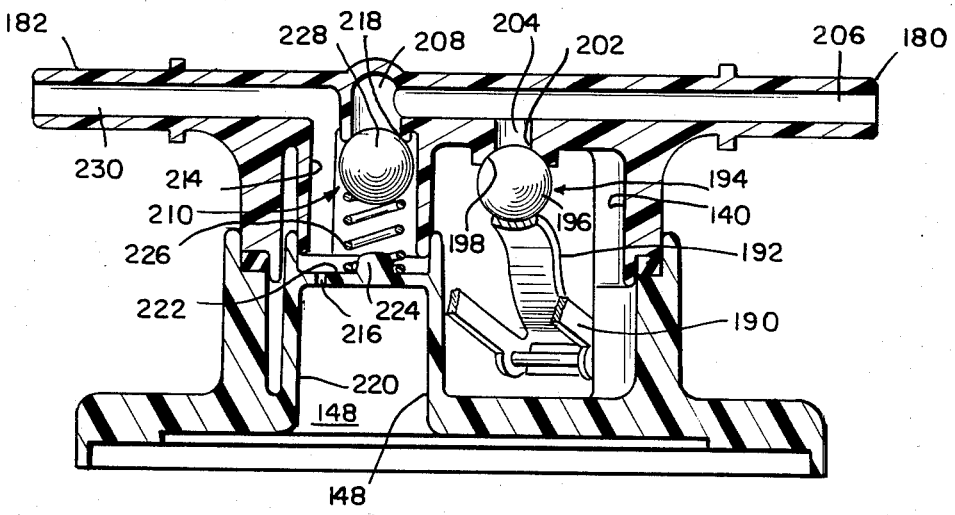
FIG. 4 is a side transverse view of the fuel reservoir shown in FIG. 2, taken along the line 4—4 in FIG. 2.

The in-line fuel reservoir 100 is shown more particularly in FIGS. 2–4. Reservoir 100 has a lower portion or filter cartridge assembly 102 and a upper portion or valve-body assembly 104. Filter cartridge assembly 102 includes a container 106 and a circular cover plate 108. Cover plate 108 is fastened to the top of container 106 by crimping as shown at 107 in FIG. 3.

Cover plate 108 has a circular inclined section 109 and a cylindrical post 110 extending axially downwardly from the center thereof. Post 110 has an axially extending threaded opening 112 therethrough. The inclined section 109 includes at least one aperture 114 for allowing fuel to pass therethrough.

Valve-body assembly 104 has a top member 116 mated with a bottom member 118. Bottom member 118 comprises a circular base plate 120 which has an axially downwardly extending cylindrical threaded post 122 and an axially upwardly extending post 124. Base plate 120 further includes axially upwardly extending walls 128 forming an axially upwardly opening cavity 132 around post 124. Walls 128 include an axially upwardly facing radially inwardly extending shoulder 144. At least one fuel inlet opening 130 is provided in circular base plate 120.

Top member 116 has an axially downwardly extending center post 134 mated in sealing relationship with cylindrical post 124 by a sealing member 136. Top member 116 also has axially downwardly extending walls 138 in spaced relationship to cylindrical center post 134 so to provide axially downwardly opening cavity 140. Walls 138 include an axially downwardly facing radially outwardly extending shoulder 142. Top member 116 further includes a plurality of axially downwardly extending fingers 117. Each finger 117 has, at its distal end 119, a radially outwardly extending shoulder 121. Plate 120 has a slot 123 extending therethrough for each finger 117. Top member 116 is fastened to bottom member 118 by forcing fingers 117 through the slots 123 so that they engage bottom plate 120. The shoulders 121 of fingers 117 snap into place to facilitate assembly of the top member 116 with the bottom member 118. A sealing member 146 is positioned between annular shoulders 142 and 144 to sealably mate walls 128 with walls 138. Cavities 132, 140 are thereby combined to form a float chamber 148.

Threaded center post 122 of bottom member 118 has a recessed portion 150 at its distal end for frictionally receiving fuel outlet tube 152. Fuel outlet passageway 154 is provided by fuel outlet tube 152, threaded post 122, and posts 124, 134. Fuel outlet passageway 154 includes a radially outwardly extending portion 156 terminating at a fuel outlet 158. A fuel inlet passageway 159 extends axially upwards within the top member 116 and then radially outwardly to a fuel inlet 160. Passageway 159 connects fuel inlet 160 to the float chamber 148.

Filter cartridge assembly 102 is fastened to valve-body assembly 104 by threaded engagement of threaded center post 122 with threaded opening 112. Filter cartridge assembly 102 is rotated until a lower surface 166 of bottom plate 120 compressably engages sealing member 164. Sealing member 164 is carried on the upper surface 162 of cover plate 108. Compression of sealing member 164 sealably mates the filter cartridge assembly 102 with the valve-body assembly 104.

In the illustrative embodiment, a fuel filter 168 is shown frictionably fastened at an outer circumferential surface 170 of cylindrical center post 110. Fuel filter 168 may also be retained in position by a spring (not shown) engaging the bottom of the filter 168. Fuel filter 168 encloses fuel outlet tube 152. Annular sealing ring 172 is compressed by an axial upper end 174 of fuel filter 168 against a bottom surface 176 of the inclined portion 109 of cover 108. Fuel filter 168 has filter media 178. It should be understood that the fuel filter 168 aids in the performance of the invention but the invention would operate in its intended manner without it. When fuel filter 168 is utilized, openings 114 open into the container 106 external to the region enclosed by the fuel filter 168.

Referring more particularly to FIG. 2, top member 116 has a fuel return inlet 180. The fuel-return line 22 couples the fuel return inlet 180 to the engine 21, as best shown in FIG. 1. Top member 116 also includes a fuel return outlet 182. The fuel return line 24 couples the fuel return outlet 182 to the fuel tank 14, preferably towards the top of the fuel tank as shown in FIG. 1.

As best shown in FIGS. 2 and 4 a float 188 in the float chamber 148 actuates a return-to-reservoir ball check-valve 194. Float 188 may be a conventional float of the type used in automobile carburetors. Return-to-reservoir ball check-valve 194 includes ball 196. The top member 116 provides an annular valve seat 198. Valve seat 198 is formed by a return-to-reservoir orifice 202 at the lower end of fuel passageway 204. Fuel passageway or first fuel opening 204 connects the float chamber 148 to a radially extending portion of a fuel-return inlet passageway 206.

Valve-body assembly 102 has a fuel-return chamber 214 formed between top member 116 and bottom member 118. Bottom member 118 has an air/vapor vent 216 connecting the fuel-return chamber 214 to the float chamber 148. Otherwise, fuel-return chamber 214 is isolated from float chamber 148.

A second fuel opening 208 extends axially downwardly in top member 116 and opens into fuel return chamber 214 to connect fuel return inlet 180 to fuel-return outlet 182. An annular valve seat 218 for return-line ball check-valve 210 is formed by top member 116. Bottom member 118 has an inverted cup-like member 220 having an axially upwardly facing surface 222 forming the bottom of fuel-return chamber 214. Surface 222 has a boss 224 extending axially upward which is directly beneath annular valve seat 218. A valve spring 226 is centered around boss 224. A ball 228 is seated on the upper end of the spring 226. The ball 226 is urged axially upward against annular valve seat 218, normally to close the second fuel opening 208. A fuel-return outlet passageway 230 extends radially outward through top member 116. Passageway 230 connects fuel-return chamber 214 to the fuel return outlet 182.

Referring to FIGS. 1–4, the operation of the apparatus is described. Fuel is pumped by the low-pressure pump 16 from the fuel tank 14 into fuel inlet 160. Assuming the reservoir 100 is empty of fuel, fuel will flow into float chamber 148 through fuel inlet 160 and fuel inlet passageway 159. The fuel will then flow out of float chamber 148 and into the bottom portion 102 through fuel openings 130, 114. Fuel will then begin to accumulate in the filter-cartridge assembly 102. Ignoring the effect of fuel filter 168 which will be described later, the fuel level in the bottom portion will rise and eventually reach the level of the lower end of fuel outlet tube 152. At this point, fuel will begin to be sucked through fuel outlet passageways 154, 156 by high-pressure pump 18. At this point, float 188 is in its lower position due to gravity, thereby carrying ball 196 away from valve seat 198 opening return-to-reservoir ball check-valve 194.

As discussed previously, fuel is diverted from engine 21 into the fuel-return line 22. This fuel is carried into fuel-return passageway 206 through fuel-return outlet 180. Ball 228 is normally urged axially upwards against valve seat 218 by spring 226 so that return-line ball check-valve 210 is normally in a closed position, thereby preventing fuel from flowing into fuel-return chamber 214 through second fuel opening 208.

Since return-to-reservoir ball check-valve 194 is open at this point, fuel will flow from fuel-return passageway 206 into float chamber 148 and subsequently into filter cartridge assembly 102 through fuel openings 130, 114 as discussed previously. As can be appreciated, the volumetric flow of fuel into the reservoir 100 from the low-pressure pump 16 and diverted from the engine 21 via the fuel-return line must be greater than the amount supplied to the fuel-injection system of engine 21 by the high-pressure pump 18.

Fuel will continue to be accumulated in the filter and cartridge assembly 102 and will eventually accumulate in the float chamber 148 when the filter and cartridge assembly 102 is filled. As the fuel level in the float chamber 148 rises, float 188 will be carried upwards, moving ball valve actuating arm 192 upwards. Arm 192 will eventually force ball 196 against valve seat 198 when the float chamber 148 has filled to a predetermined level, thereby closing return-to-reservoir ball check-valve 194.

When return-to-reservoir ball check-valve 194 closes, there will be a substantial pressure increase in the fuel-return passageway 206 and second fuel opening 208. This pressure increase will urge ball 228 of return-line ball check-valve 214 axially downwards, compressing spring 228 and opening return-line ball check-valve 214. Fuel will now flow through second fuel opening 208 into fuel-return chamber 214 and, when chamber 214 fills, back to the fuel tank 14 through passageway 230 and fuel-return outlet 182. Should the low-pressure pump 16 at this juncture be supplying more fuel than the high-pressure pump 18 is drawing from tne reservoir 10, the additional fuel will be recirculated back to the fuel tank 14 through vent 216, chamber 214, passageway 230, and fuel-return outlet 182.

When the low pressure pump 16 sucks in a quantity of air due to turbulence in the fuel tank 14 caused by such factors as a rough road or a turn, the air will be pumped into the reservoir as the fuel was. The air will percolate upwards and be exhausted back to the fuel tank through air/vapor vent 216. However, the high-pressure pump 18 will have continued to draw fuel from the reservoir so that the fuel level within reservoir 100 will drop.

Once the fuel level drops below the predetermined level, float 188 will have fallen to the point that return-to-reservoir ball check-valve 194 opens. The opening of ball check-valve 194 will cause a pressure drop in fuel-return passageway 206 and second fuel opening 208. This pressure drop will then allow return-line ball check-valve 214 to close. The reservoir is now filled from the fuel-return line as discussed previously. Eventually, the low-pressure pump will return to pumping fuel and the apparatus will return to working as described.

The operation of fuel filter 168 is now described. Fuel filter 168 encloses fuel outlet tube 152 as described. The fuel is introduced into the filter and cartridge assembly 102 outside of the enclosed region. Therefore, all fuel drawn into the high-pressure pump 18 must pass through the fuel filter 168.

In many cases, bubbles of gas will be entrained in the fuel. As the fuel passes through the filter media 178, these bubbles are dislodged and will percolate upwards and be exhausted to the fuel tank 14 through air/vapor vent 216. Fuel filter 168 will also act in a conventional filtering manner to remove impurities from the fuel.

When the low-pressure pump 16 is operating under normal conditions, fuel is being delivered to the reservoir 100 at a flow rate greater than that being discharged by the high-pressure pump 18. This flow condition maintains the fuel level in the reservoir 100 to a filled condition; refills the reservoir 100 after those periods when the low-pressure pump was subjected to air/vapors during in-tank 14 fuel sloshing; and creates a positive pressure level in the reservoir 100 to force the air/vapors to exit the filter and cartridge assembly 102 (FIG. 3) through the air/vapor vent 216 (FIG. 3).

When the low-pressure pump 16 is not delivering fuel to the reservoir 100, the fuel level in the reservoir 100 will drop in direct proportion to the amount of fuel being used by the engine. This condition creates a void in the reservoir 100 and subsequently a negative pressure level that, if uncontrolled, would have an adverse effect on the performance of the high-pressure pump 18.

This negative pressure is minimized by the created pressure differential between the reservoir 100 and fuel tank 14 acting to force the contents of the fuel line 19 between the low-pressure pump 16 and reservoir 100 into the reservoir 100. Further, this created pressure differential will also act to draw air/vapors from the fuel tank into the reservoir 100 through the fuel return outlet 182 (FIG. 2) and air/vapor vent 216 (FIG. 3).

Although the invention has been described in detail with reference to certain preferred embodiments and specific examples, variations and modifications exist within the scope and spirit of the invention as described and as defined in the following claims.

What is claimed is:

1. In a fuel supply system having a high-pressure pump for pumping fuel to an engine, a low-pressure pump for pumping fuel from a fuel tank to the high-pressure pump, a fuel reservoir comprising means providing a fuel supply chamber, means providing a fuel supply inlet to the fuel supply chamber, means for coupling the fuel supply inlet to the low-pressure pump, means providing a fuel supply outlet from a fuel supply chamber, means for coupling the fuel supply outlet to the high-pressure pump, means providing a fuel return inlet, means providing a fuel return outlet, means providing a first fuel opening between the fuel return inlet and the fuel supply chamber, means providing a second fuel opening between the fuel return inlet and the fuel return outlet, means for coupling the fuel return inlet to the engine, means for coupling the fuel return outlet to the fuel tank, and valve means for controlling the flow of fuel through the first and second fuel openings to direct returned fuel to the fuel supply chamber and the fuel tank, the valve means including a first valve means for closing the first fuel opening when a predetermined level of fuel is present in the fuel supply chamber to direct returned fuel through the second fuel opening and the fuel return outlet and for opening the first fuel opening when the fuel in the fuel supply chamber is below the predetermined level to allow returned fuel to enter the fuel supply chamber.

2. The reservoir of claim 1 wherein the valve means includes second valve means for closing the second fuel opening to prevent fuel flow from the fuel return inlet to the fuel return outlet when the fuel level in the fuel supply chamber is below the predetermined level and for opening the second fuel openings to allow fuel flow from the fuel return inlet to the fuel return outlet when the fuel within the fuel supply chamber is at the predetermined level.

3. The reservoir of claim 2 wherein the first valve means comprises a float ball-valve having a valve member and a float within the fuel supply chamber coupled to the valve member for closing the first fuel opening when the fuel in the fuel supply chamber is at the predetermined level and opening the first fuel opening when the fuel level in the fuel supply chamber is below the predetermined level, and the second valve means comprises a normally closed ball-check-valve having a valve member and resilient means for normally urging the valve member to close the second fuel opening, the resilient means is compressed by an increase in pressure in the fuel return inlet to open the second fuel opening.

4. The reservoir of claim 3 further comprising means providing a vent opening between the fuel supply chamber and the fuel return outlet.

5. The reservoir of claim 4 wherein the second fuel opening is downstream from the first fuel opening and the vent opening is downstream from the second fuel opening.

6. In a fuel supply system having a high-pressure pump for pumping fuel to an engine, a low pressure pump for supplying fuel from a fuel tank to the high pressure pump, a fuel reservoir comprising means providing a full supply chamber, means providing a fuel supply inlet passageway to the fuel supply chamber, means for coupling the fuel supply inlet passageway to the low pressure pump, means providing a fuel supply outlet passageway from the fuel supply chamber, means for coupling the fuel supply outlet passageway to the high pressure pump, means providing a fuel return inlet passageway, means providing a first fuel opening between the fuel supply chamber and the fuel return inlet passageway, means providing a fuel return outlet passageway, means providing a second fuel opening between the fuel return inlet passageway and the fuel return outlet passageway, means for coupling the fuel return inlet passageway to the engine, means for coupling the fuel return outlet passageway to the fuel tank, and valve means for closing the first fuel opening when a predetermined level of fuel is present in the fuel supply chamber to direct returned fuel through the second fuel opening and the fuel return outlet passageway back to the fuel tank and for opening the first fuel opening when the fuel in the fuel supply chamber is below the predetermined level to allow returned fuel to enter the fuel supply chamber.

7. The reservoir or claim 6 further comprising second valve means for opening the second fuel opening when the fuel in the fuel supply chamber is at the predetermined level to allow returned fuel to flow through the return outlet passageway back to the fuel tank and for closing the second fuel opening when fuel in the fuel supply chamber is below the predetermined level to direct returned fuel through the first fuel opening into the fuel supply chamber.

8. The reservoir of claim 7 wherein the first-mentioned valve means comprises a float ball valve having a ball member, a float member within the fuel supply chamber, and means for coupling the float member to the ball member to urge the ball member against an annular valve seat surrounding the first fuel opening to close the first fuel opening when the fuel in the fuel supply chamber reaches the predetermined level and to move the ball member away from the annular valve seat to open the first fuel opening when the fuel in the fuel chamber is below the predetermined level, and the second valve means comprises a normally closed ball-check-valve having a ball member, resilient means for normally urging the ball member against an annular valve seat surrounding the second fuel opening to close the second fuel opening when the first fuel opening is open and to open the second fuel opening in response to a pressure increase in the fuel return inlet passageway when the first fuel opening is closed.

9. The reservoir of claim 8 further comprising means providing a vent opening between the fuel supply chamber and the fuel return outlet passageway.

10. The reservoir of claim 9 further comprising a fuel filter in the fuel supply chamber between the fuel supply inlet passageway and the fuel supply outlet passageway.

11. In a fuel supply system having a high-pressure pump for pumping fuel to an engine, a low pressure pump for supplying fuel from a fuel tank to the high pressure pump, a fuel reservoir comprising means providing a fuel supply chamber, means providing a fuel supply inlet passageway to the fuel supply chamber, means for coupling the fuel supply inlet passageway to the low pressure pump, means providing a fuel supply outlet passageway from the fuel supply chamber, means for coupling the fuel supply outlet passageway to the high pressure pump, means providing a fuel return inlet passageway, means providing a first fuel opening between the fuel supply chamber and the fuel return inlet passageway, means providing a fuel return outlet passageway, means providing a second fuel opening between the fuel return inlet passageway and the fuel return outlet passageway, means for coupling the fuel return inlet passageway to the engine, means for coupling the fuel return outlet passageway to the fuel tank, valve means for closing the first fuel opening when a predetermined level of fuel is present in the fuel supply chamber to direct returned fuel through the second fuel opening and the fuel return outlet passageway back to the fuel tank and for opening the first fuel opening when the fuel in the fuel supply chamber is below the predetermined level to allow returned fuel to enter the fuel supply chamber, and means providing a vent opening between the fuel supply chamber and the fuel return outlet.

12. The reservoir of claim 11 further comprising second valve means for opening the second fuel opening when the fuel in the fuel supply chamber is at the predetermined level to allow returned fuel to flow through the return outlet passageway back to the fuel tank and for closing the second fuel opening when fuel in the fuel supply chamber is below the predetermined level to direct returned fuel through the first fuel opening into the fuel supply chamber.

13. In a fuel supply system having a high-pressure pump for pumping fuel to an engine, a low-pressure pump for pumping fuel from a fuel tank to the high-pressure pump, a fuel reservoir comprising a valve-body assembly, a filter cartridge assembly, a fuel filter in the filter cartridge assembly, means for removably coupling the filter cartridge assembly to the valve-body assembly, the valve-body assembly including means providing a fuel supply inlet coupled to the low-pressure pump, means providing a fuel supply outlet coupled to the high-pressure pump, means providing a fuel return inlet coupled to the engine, means providing a fuel return outlet coupled to the fuel tank, the filter cartridge assembly including means providing a fuel supply chamber, the valve body assembly further including means for coupling the fuel supply inlet in fluid communication with the fuel supply chamber, means for coupling the fuel supply outlet in fluid communication with the fuel supply chamber, means providing fluid communication between the fuel return inlet and the fuel supply chamber, means providing fluid communication between the fuel return inlet and the fuel return outlet, and valve means for preventing the flow of fuel from the fuel return inlet to the fuel supply chamber when the fuel in the fuel supply chamber is at a desired level and for allowing the flow of fuel from the fuel return inlet to the fuel supply chamber when the fuel in the fuel chamber is below the desired level.

14. The reservoir of claim 13 wherein the valve body assembly further includes means providing an air/vapor vent between the fuel supply chamber and the fuel return outlet.

* * * * *